US011939822B2

(12) United States Patent
Steine et al.

(10) Patent No.: US 11,939,822 B2
(45) Date of Patent: Mar. 26, 2024

(54) CONTROL LINE PROTECTOR ASSEMBLY

(71) Applicant: Ace Well Technologies AS, Randaberg (NO)

(72) Inventors: Ken Erik Steine, Hafrsfjord (NO); Morten Klausen, Mosterøy (NO); Espen Sørbø, Randaberg (NO); Lasse Hetland, Stavanger (NO)

(73) Assignee: Ace Well Technologies AS, Randaberg (NO)

( * ) Notice: Subject to any disclaimer, the term of this patent is extended or adjusted under 35 U.S.C. 154(b) by 0 days.

(21) Appl. No.: 17/636,287

(22) PCT Filed: Aug. 19, 2020

(86) PCT No.: PCT/EP2020/073240
§ 371 (c)(1),
(2) Date: Feb. 17, 2022

(87) PCT Pub. No.: WO2021/032796
PCT Pub. Date: Feb. 25, 2021

(65) Prior Publication Data

US 2022/0298871 A1 Sep. 22, 2022

(30) Foreign Application Priority Data

Aug. 19, 2019 (GB) ..... 1911883

(51) Int. Cl.
*E21B 17/10* (2006.01)

(52) U.S. Cl.
CPC ..... *E21B 17/1035* (2013.01)

(58) Field of Classification Search
None
See application file for complete search history.

(56) References Cited

U.S. PATENT DOCUMENTS 3,040,405 A * 6/1962 Solum ..... E21B 37/02 24/114.5
4,484,785 A * 11/1984 Jackson ..... E21B 17/1035 138/112

(Continued)

FOREIGN PATENT DOCUMENTS

CN 106968613 A * 7/2017
WO 2014011056 1/2014

(Continued)

OTHER PUBLICATIONS

Search Report for UK Application No. GB1911883.5, dated Jan. 15, 2020.

(Continued)

*Primary Examiner* — Kipp C Wallace
(74) *Attorney, Agent, or Firm* — Andrus Intellectual Property Law, LLP

(57) ABSTRACT

A control line protector for protecting one or more downhole control lines running alongside a pipe, comprising a body with one or more channels, wherein each of the one or more channels is adapted to receive a control line, and an attachment assembly coupled to the body for attachment to an outer surface of the pipe, wherein the attachment assembly comprises an inner collar comprising a tubular portion and a plurality of gripping arms extending axially away from the tubular portion and arranged to deflect radially inwards and an outer sleeve adapted to slide at least partially over the inner collar, wherein when the inner collar and the outer sleeve are arranged axially around the pipe and pressed together each of the plurality of gripping arms is deflected radially inwards by the outer sleeve to grip the pipe and thereby secure the body to the outer surface of the pipe.

20 Claims, 16 Drawing Sheets

(56) References Cited

U.S. PATENT DOCUMENTS

| | | | | |
|---|---|---|---|---|
| 6,206,133 | B1 * | 3/2001 | Paulsson | G01V 1/52 181/102 |
| 7,124,818 | B2 * | 10/2006 | Berg | E21B 17/1021 166/250.01 |
| 11,448,343 | B2 * | 9/2022 | Hagen | E21B 17/026 |
| 2004/0065437 | A1 * | 4/2004 | Bostick, III | G01V 1/52 166/250.01 |
| 2008/0311776 | A1 * | 12/2008 | Cox | E21B 47/00 166/313 |
| 2010/0116509 | A1 | 5/2010 | Robert et al. | |
| 2011/0303419 | A1 * | 12/2011 | Maier | E21B 33/126 166/373 |
| 2014/0014373 | A1 * | 1/2014 | Richards | E21B 17/1035 166/242.6 |
| 2015/0191982 | A1 * | 7/2015 | Steine | E21B 19/24 166/241.6 |
| 2016/0333646 | A1 * | 11/2016 | Olin | E21B 47/135 |
| 2016/0376852 | A1 * | 12/2016 | von Gynz-Rekowski | E21B 33/1291 166/380 |
| 2018/0148983 | A1 * | 5/2018 | Hagen | F16L 3/06 |
| 2018/0148997 | A1 * | 5/2018 | Goodman | E21B 33/1208 |

FOREIGN PATENT DOCUMENTS

| | | |
|---|---|---|
| WO | 2015163909 | 10/2015 |
| WO | 2017009440 | 1/2017 |

OTHER PUBLICATIONS

International Search Report and Written Opinion for PCT Application No. PCT/EP2020/073240, dated Nov. 30, 2020.

* cited by examiner

CONTROL LINE PROTECTOR ASSEMBLY

BACKGROUND

Control lines are used to control, provide power to, and communicate with downhole equipment during hydrocarbon extraction. Control lines may be electrical cables, fibre optic lines or hydraulic lines for example, and they can be connected to a variety of downhole equipment such as hydraulic pumps, valves and sensors.

Control lines are commonly arranged around the outside of a production tubing and are run into a wellbore in parallel with the tubing. Multiple control lines may run alongside each other and perform different tasks, and control lines from different manufacturers may be manufactured to different specifications and have different dimensions. Sections of control lines can be joined together using control line connectors, and multiple control lines can be spliced within a single housing and separated out as needed.

Exposed control lines alongside a production tubing are at risk of being damaged from contact with other wellbore components, especially at joints between tubing or casing sections or at the rotary table. For example, the production tubing may move relative to the rotary table, particularly in adverse weather conditions, thereby causing surrounding control lines to be crushed between the production tubing and the rotary table or the casing.

Control lines are also at risk of being damaged at the connection points between sections of control line. A connection is inherently one of the weakest locations along the length of a control line, and control line connectors generally protrude radially from the surface of the control line and are therefore at risk of catching on other components.

Damage to control lines can result in considerable production downtime in order to allow for repairs to be made.

It is known to mount control line protectors to a production tubing in an attempt to mitigate these problems. Such protectors shield the control lines and act as a barrier between the control lines and their surroundings, thereby preventing the control lines from being damaged by contact with nearby objects.

Control line protectors may also have slots or channels into which the control lines or control line connectors are inserted. These slots help to align the control lines with the tubing and with each other, which ensures that the control lines remain in the correct position and reduces the risk of the control lines becoming twisted or tangled.

Known methods of mounting control line protectors to a tubing often use pins or screws or require the tubing to be modified, for example the tubing may be adapted to have slots into which a control line protector can be fitted, or the control line protector may be welded to the tubing. While this results in secure attachment between the control line protector and the tubing, such use of pins or screws and modifications can affect the structural integrity of the tubing and weaken the tubing. For example, forming slots in the tubing by removing material will reduce the thickness of the tubing wall, and welding will subject the tubing to extreme heat and cause permanent deformation.

Although control line protectors that don't require modification of the tubing exist, the attachment between these control line protectors and the tubing is often relatively weak, meaning they are at risk of slipping in the axial or circumferential directions of the tubing. Known methods of mounting control line protectors therefore compromise between the integrity of the tubing and the strength of the coupling between the control line protector and the tubing.

In addition, installing control line protectors by welding or inserting pins and screws is labour intensive and time consuming.

There is a need for control line protectors that can be quickly and easily mounted to smooth sections of tubing without requiring modification of the tubing.

SUMMARY OF THE INVENTION

According to a first aspect of the invention, there is provided a control line protector for protecting one or more downhole control lines running alongside a pipe, comprising: a body with one or more channels, wherein each of the one or more channels is adapted to receive a control line; and, an attachment assembly coupled to the body for attachment to an outer surface of the pipe, wherein the attachment assembly comprises: an inner collar comprising a tubular portion and a plurality of gripping arms extending axially away from the tubular portion and arranged to deflect radially inwards; and, an outer sleeve adapted to slide at least partially over the inner collar, wherein when the inner collar and the outer sleeve are arranged axially around the pipe and pressed together each of the plurality of gripping arms is deflected radially inwards by the outer sleeve to grip the pipe and thereby secure the body to the outer surface of the pipe.

Attachment in this way means that the control line protector can be attached to a tubing by only pressing the gripping arms into the sleeve. No pins, screws or welding are required to attach the control line protector to the pipe. In addition, the diameter of pipe that the control line protector can be attached to can be within a relatively wide tolerance range, as the variable inner circumference of the control line protector allows it to be easily attached to tubings with different outer diameters. When compared to conventionally mounted control line protectors, this reduces the need for multiple size options and significantly reduces the cost of equipment manufacture and inventory overheads. In addition, the attachment of the gripping arms to the pipe due to the deflection of the arms allows a very strong gripping force to be applied to the tubing. Further advantages include the simple and low cost of construction.

The body may be substantially tubular and shaped to run alongside a pipe, for example with a circular or semi-circular cross section, i.e. it may completely surround the circumference of the pipe or only a part of it. The body may be referred to as a protective element.

The control lines may be electrical cables, fibre optic lines or hydraulic lines or any other type of control line, and the control lines may be connected to any type of downhole equipment, such as hydraulic pumps, valves and sensors.

Optionally, the body may comprise part of the attachment assembly. This allows the body to be securely fixed to the pipe in a way that prevents relative axial or rotational movement of the body.

Optionally, the part of the attachment assembly that the body comprises may be the inner collar. Alternatively, that part of the attachment assembly that the body comprises may be the outer sleeve.

Alternatively, the attachment assembly may be separate to the body.

Optionally, the attachment assembly may be coupled to the body such that the body can move rotationally about the pipe relative to the attachment assembly. For example, the inner collar of the attachment assembly may comprise a plurality of latching arms on an opposite side of the inner collar to the gripping arms. Such latching arms may latch to a circumferential recess, slot or groove on the inner or outer surface of the body, thereby preventing axial movement but allowing rotational movement.

Optionally, the relative rotational movement may be limited to a predetermined range of rotational angles about the axis of the pipe that is less than a complete rotation. For example, each latching arm may latch to a separate recess or groove on the body, wherein a width of each recess is slightly greater than a width of each latching arm. This provides some rotational tolerance to reduce strain on the control lines, while still limiting rotation in order to prevent the cables becoming tangled. Larger recesses allow for greater rotation.

Alternatively, the width of each recess may correspond closely to the width of each latching arm. Such a coupling also restricts relative rotational movement of the attachment mechanism.

Preferably, the control line protector further comprises a second attachment assembly coupled to the body. This increases the attachment strength.

Preferably, the attachment assembly is arranged at one end of the body and the second attachment assembly is arranged at an opposite end of the body.

Preferably, the control line protector further comprises a shielding element configured to be coupled to the body such that, in use, the shielding element protects sections of the downhole control lines in a region adjacent to the body. The shielding element may be coupled to an end of the body and arranged substantially parallel to the pipe such that in use it protects the control lines. The shielding element is shaped with a cross section similar to the arc of a circle, and may optionally have a circular cross section.

Preferably, the control line protector further comprises an additional body configured to be coupled to the shielding element. The additional body may be similar to or substantially the same as the body. The body and the additional body may be arranged in use with an axial separation along the pipe, with opposite ends of the shielding element coupled to the body and the additional body, thereby protecting the control lines in a region between the body and the additional body. Use of another body in this manner provides more secure attachment of the shielding element.

Preferably, the additional body comprises one or more further attachment assemblies.

Preferably, the additional body comprises two further attachment assemblies, wherein the two further attachment assemblies are arranged at opposing ends of the additional body.

Preferably, the shielding element is securable to the body using bolts or screws. This allows for easy removal of the shielding element when servicing control lines.

Preferably, the body comprises a shield groove for receiving an end of the shielding element. This simplifies installation by reducing the number of bolts or screws required to install the shielding element, thereby reducing installation time.

Preferably, an axial edge of the shielding element comprises a lip which, in use, is arranged to substantially enclose sections of the control lines in a region between the shielding element and the pipe. This provides improved protection of the control lines. The axial edges of the shielding element are those that are parallel to the axis of the pipe. The lip may be formed by a radially inward protrusion.

Preferably, an inner diameter of the outer sleeve is tapered to form a conical abutment face and a narrow end of the outer sleeve has an inner diameter less than an outer diameter of the plurality of gripping arms of the inner collar, such that when the outer sleeve and inner collar are arranged axially around the pipe and pressed together the gripping arms are deflected radially inward by the conical abutment face to grip the pipe to mount the attachment assembly to the pipe. The magnitude of deflection of the gripping arms, and therefore the internal circumference defined by the gripping arms, depends on how far the sleeve is pressed over the gripping arms, with the deflection increasing as the sleeve is pressed further over the gripping arms.

Preferably, the control line protector further comprises a plurality of circumferential ridges on an outer wall of the plurality of gripping arms arranged to cooperate with a corresponding plurality of circumferential ridges on an inner wall of the outer sleeve to form a ratchet.

The ridges may be pawls or serrations for example. The ratchet ensures that the inner collar remains secured within the sleeve such that the gripping arms are maintained in a deflected position to grip the pipe. Moreover the axial load which the assembly can withstand is significantly increased by the abutment of a circumferential ridge of the sleeve element against a circumferential ridge of the gripping arms.

Preferably, each of the plurality of circumferential ridges on the outer wall of the plurality of gripping arms comprises a sloped first side face facing a distal end of the inner collar and an opposite second side face forming an abutment surface perpendicular to a central axis of the inner collar, and wherein the plurality of circumferential ridges on the inner wall of the outer sleeve have a complementary cross section to a cross section of the plurality of circumferential ridges on the outer wall of the plurality of gripping arms. The distal end of the inner collar is the end with the tips of the gripping arms.

This increases the axial load that the attachment assembly can withstand. For example, if an axial load is applied to the sleeve when the attachment assembly is installed, the perpendicular ridges of the sleeve abut against the perpendicular ridges of the gripping arms, preventing sleeve from moving.

Preferably, each gripping arm of the plurality of gripping arms comprises a plurality of gripping teeth arranged on an inner face of the gripping arm to grip the outer surface of the pipe.

The gripping teeth provide a force on the pipe when the assembly is installed that helps prevent axial or radial movement of the attachment assembly.

Preferably, each of the plurality of gripping teeth extends circumferentially around the inner face of the gripping arm. This provides a force on the pipe to prevent axial movement of the attachment assembly.

Preferably, each of the plurality of gripping arms is tapered to form a tapered outer face. Preferably, the tapering angle of the gripping arms corresponds to the tapering angle of the outer sleeve. This tapering allows for more effective abutment between the surfaces of the sleeve and the gripping arms.

Preferably, the tapered outer face is arranged to protrude radially outward from the gripping arm, resulting in a rim on an outer surface of the gripping arm. This increases the contact area between the gripping arms and the outer sleeve during abutment.

Preferably, the plurality of gripping arms is formed by a plurality of slits extending axially from a distal end of the inner collar. Preferably, all of the plurality of slits are parallel to each other.

Preferably, each of the one or more channels comprises a wider portion adapted to receive a control line connector and a narrower portion adapted to receive a control line. This restricts axial movement of the control line connectors as the narrower portions are too narrow for the control line connector to fit into. During relative axial movement of the body and the control line, the control line connector abuts against the ends of the wider portions of the channel where the channel narrows. The wider portion of each channel may be wider and/or deeper than the narrower portion.

Preferably, each of the one or more channels comprises one or more covers for retaining the control line or control line connector in the respective channel. This allows for the control lines to be held securely in position within the channels. Preferably the covers are removable. Using removable covers allows for improved servicing of the control lines.

The covers may be any covers, hatches or retaining elements that function to retain control lines and/or control line protectors in the channels and prevent them from moving radially out of the channels. Friction between the covers and the control lines or control line protectors may optionally also function to restrict axial movement of the control lines and/or control line connectors.

Optionally, the one or more covers are securable to the body using bolts or screws.

Preferably, the body comprises one or more cover openings for receiving at least part of the one or more covers. Each cover opening retains part of a removable cover and restricts movement the cover, meaning fewer bolts or screws are required to secure the cover. This simplifies installation as the covers take less time to install.

Preferably, the body further comprises one or more cover grooves that allow the one or more covers to be slideably positioned in the one or more cover openings. This allows for easier installation of the covers.

Preferably, the body further comprises one or more recesses for receiving the one or more covers, wherein in use, each of the one or more covers is positioned in a corresponding recess such that at least a part of each cover is positioned below an outer surface of the body. This allows at least part of each cover to be positioned radially inward from an outer surface of the body, thereby reducing the magnitude of protrusion of the cover above the outer surface of the body and allowing the use of thicker and stronger covers. Reducing the protrusion reduces the risk of the covers catching on downhole equipment when the control line protector is attached to a tubing and lowered into a wellbore.

Preferably, the covers have a rough inner surface. The inner surface is the surface that faces radially inward when the covers are installed, and is the surface that abuts the control line connectors. Preferably, the control the channels have a rough surface. A rough or textured surface increases the coefficient of friction between the covers or channels and the control lines and control line connectors, therefore reducing the risk of the control lines slipping. The rough surfaces may be textured, for example.

Preferably, the body further comprises an installation tool groove for receiving part of an installation tool such that, during installation, the first part of the installation tool is positioned in the installation groove and a second part of the installation tool is arranged an end of the outer sleeve and the two parts of the installation tool are forced together to thereby press-fit the outer sleeve and inner collar together. This groove provides a surface for the installation tool to abut against and allows the tool to provide the necessary axial force required to press fit the elements attachment assembly together.

According to a second aspect of the invention, there is provided a method of securing the control line protector of the first aspect to a pipe, the method comprising positioning the outer sleeve and the inner collar around the pipe and press-fitting the inner collar into the outer sleeve such that contact between the outer sleeve and inner collar causes each of the plurality of gripping arms of the inner collar to deflect radially inwards thereby to grip an outer surface of the pipe.

The control line protector is preferably secured to the pipe at any time prior to the pipe being lowered into a wellbore, for example at a pipeyard or other onshore or offshore facility.

Preferably, the method further comprises positioning control line connectors and/or control lines in the channels.

Preferably, the method further comprises fixing one or more removable covers to the control line protector.

Preferably, the method further comprises fixing the shield to the control line protector.

The fixing of the removable covers and the shield may be by means of bolts, screws, welding or any other suitable mechanism, such as sliding the removable covers or shield into grooves or recesses in the body.

Optionally, the method may further comprise positioning one or more additional outer sleeves and one or more additional inner collars around the pipe and press-fitting each of the one or more additional inner collars into a respective additional outer sleeve.

According to a third aspect of the invention, there is provided a control line protector system for protecting one or more downhole control lines running alongside a pipe, comprising: one or more bodies with one or more channels, wherein each of the one or more channels is adapted to receive a control line; at least one shielding element configured to be coupled to at least one of the one or more bodies such that, in use, the shielding element protects sections of the downhole control lines in a region adjacent to the at least one of the one or more bodies; and, one or more attachment assemblies coupled to each of the one or more bodies for attachment to an outer surface of the pipe, wherein each attachment assembly comprises: an inner collar comprising a tubular portion and a plurality of gripping arms extending axially away from the tubular portion and arranged to deflect radially inwards; and, an outer sleeve adapted to slide at least partially over the inner collar, wherein when the inner collar and the outer sleeve of each attachment assembly are arranged axially around the pipe and pressed together each of the plurality of gripping arms is deflected radially inwards by the outer sleeve to grip the pipe and thereby secure the one or more bodies to the outer surface of the pipe.

Preferably, two attachment assemblies are coupled to each of the one or more bodies, wherein the two attachment assemblies are arranged at opposing ends of each respective body.

Preferably, the system comprises two bodies, and wherein the at least one shield is coupled to two bodies such that, in use, the shielding element protects sections of the downhole control lines in a region between the two bodies.

When using more than one attachment assembly, the press-fitting is repeated for each attachment assembly. When using an attachment assembly that is separate from the body, the method may further comprise positioning the body around the pipe and optionally latching the body to the attachment assembly by pressing the body onto the latching arms of the attachment assembly.

BRIEF DESCRIPTION OF DRAWINGS

Examples of the present invention will now be described in detail with reference to the accompanying drawings, in which.

DETAILED DESCRIPTION

The present invention provides an improved control line protector for attachment to the outer surface of a pipe for protecting control lines arranged around the outside of the pipe. Although the control line protector is described in relation to a device for protecting control lines arranged around the outside of a production tubing, it could also be used for protecting control lines or similar arranged around a casing string or any other tubular used in hydrocarbon extraction.

The words tubular, casing, pipe, production tubing and tubing may be used interchangeably through the present description to refer to a production tubing which is run into a wellbore within a casing or casing string.

Figure 1:
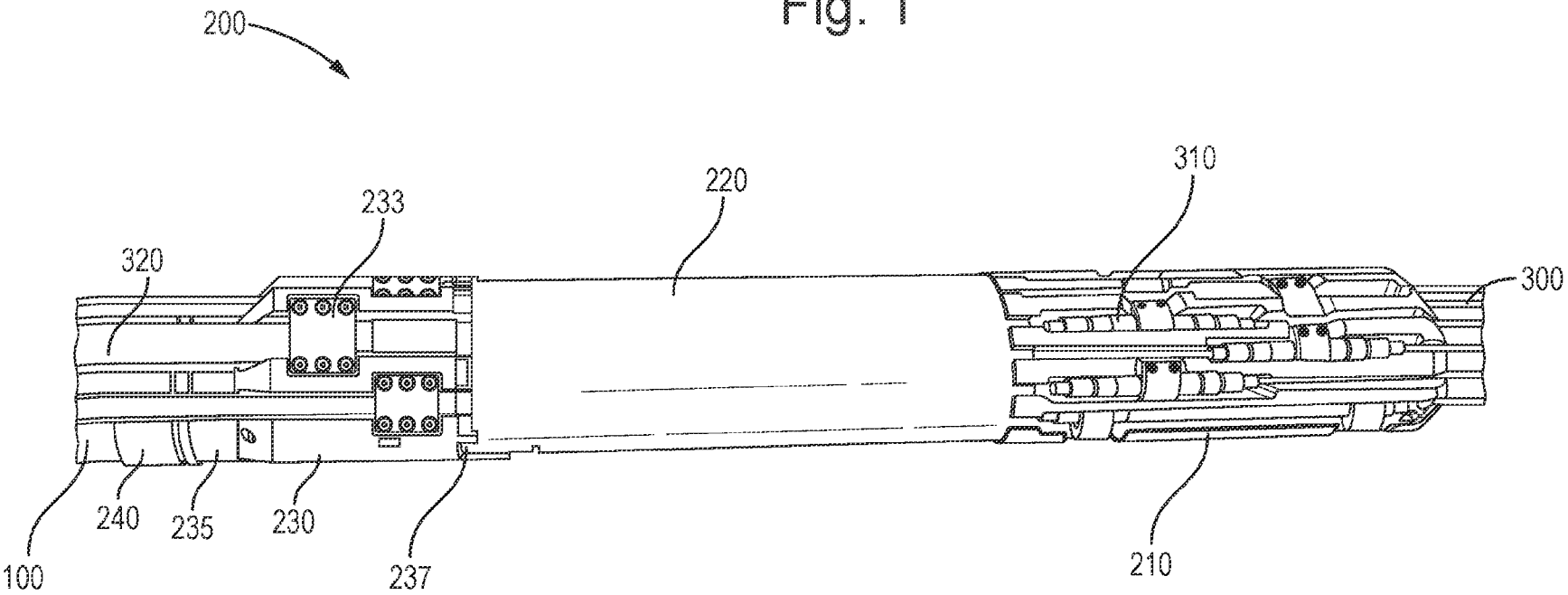
FIG. 1 shows a control line protector comprising a shield and first and second protective elements attached to a tubing.

FIG. 1 shows a control line protector 200 attached to a tubing 100, with a number of control lines 300 running parallel to the tubing 100. The control line protector 200 comprises first and second substantially tubular protective elements 210 and 230 respectively and a shield 220 coupled to the protective elements 210 and 230. The shield 220 is positioned to cover and protect the control lines 300 in the region between the protective elements 210 and 230.

Figure 2:
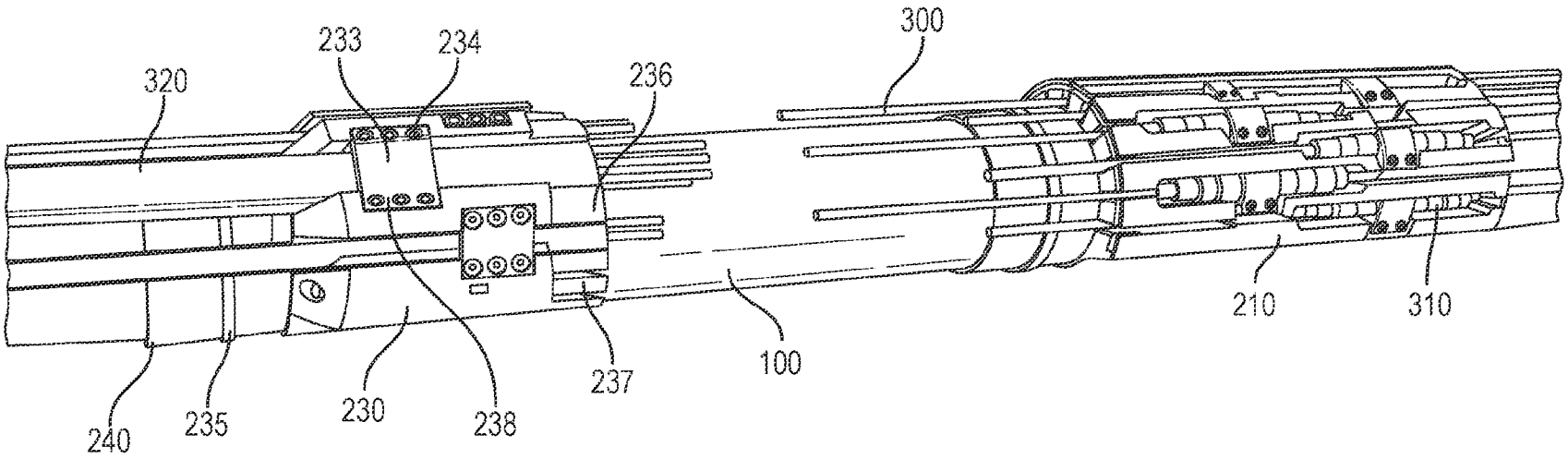
FIG. 2 shows the control line protector with the shield section removed.

As best seen in FIG. 2, which shows the control line protector 200 with the shield 220 removed to expose the control lines 300, sections of the control lines 300 are spliced together in groups within housings 320. The illustrated housings 320 have a rectangular profile, each encasing two or three control lines 300, but alternative configurations are envisaged, such as housings with a curved profile or housing more than three control lines 300. Sections of the control lines 300 are joined together by control line connectors 310. Control lines, control line housings and control line connectors are well known and will not be described in further detail.

Figure 15:
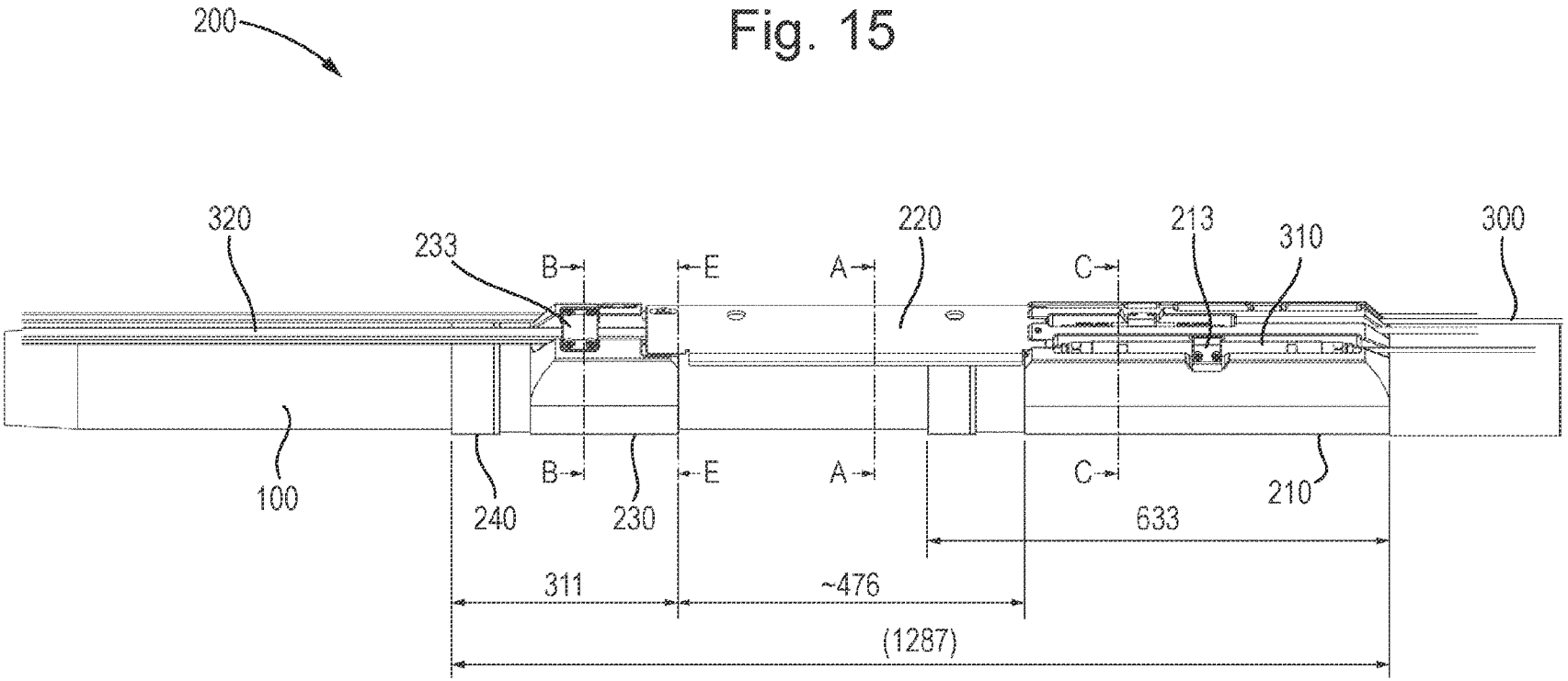
FIG. 15 is a technical drawing of the control line protector.

A technical drawing of the control line protector 200 is shown in FIG. 15.

Figure 3:
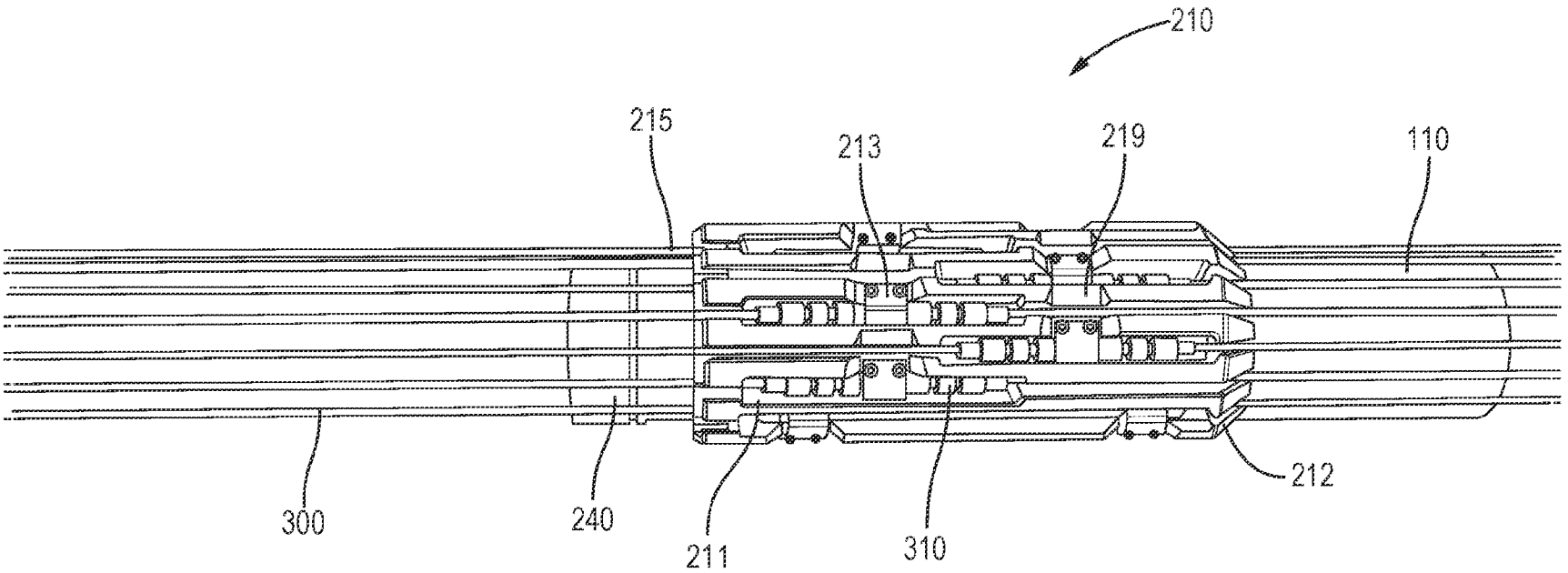
FIG. 3 shows the first protective element of the control line protector.
Figure 4:
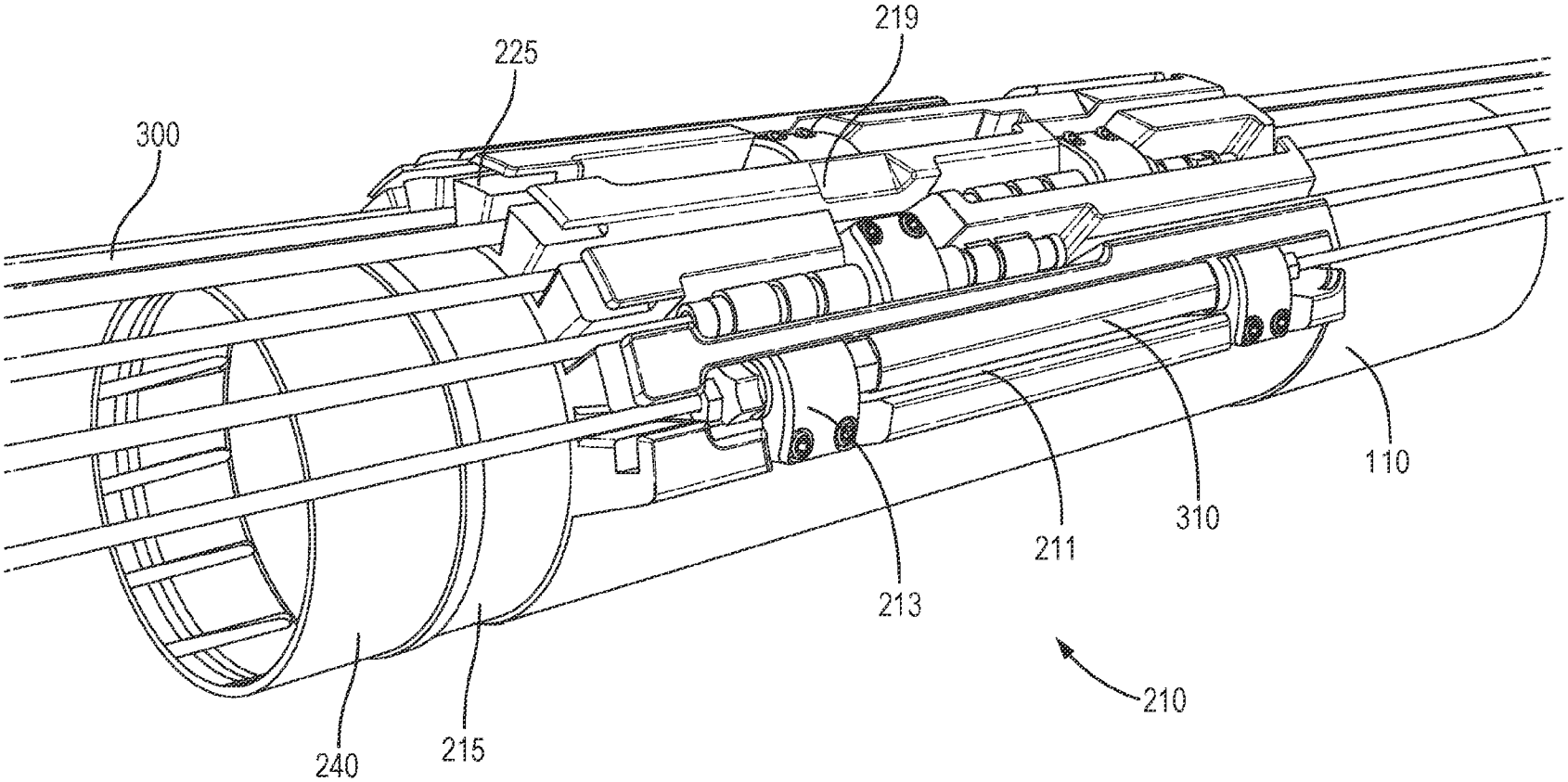
FIG. 4 shows a perspective view of the first protective element.
Figure 5:
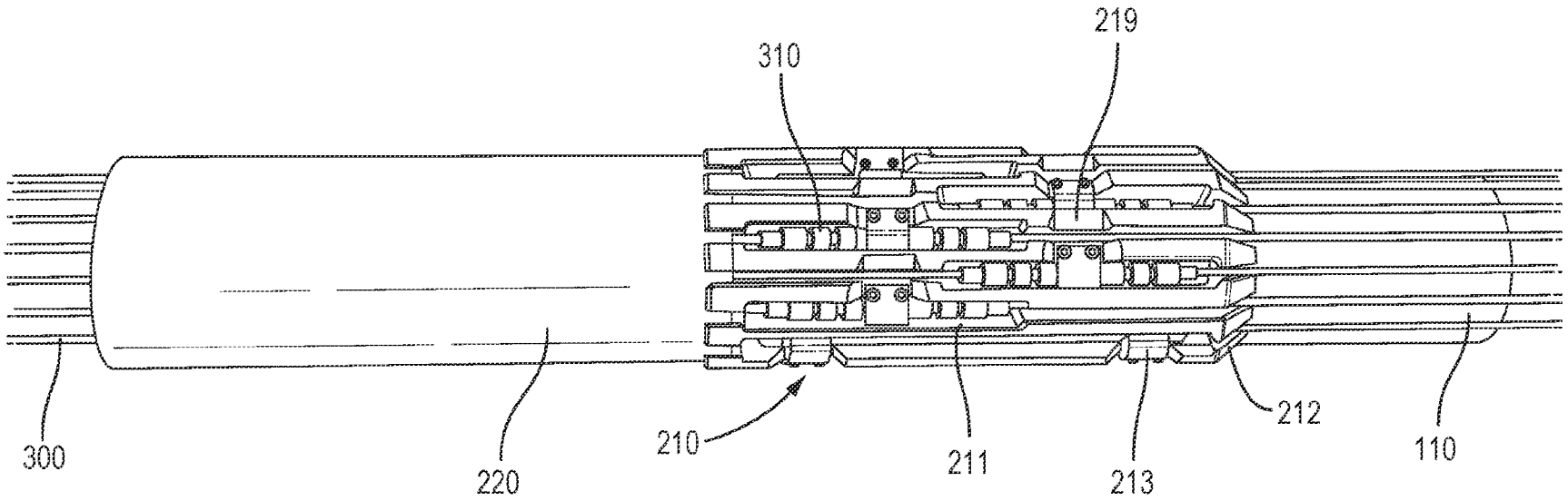
FIG. 5 shows the first protective element with the shield attached.
Figure 6:
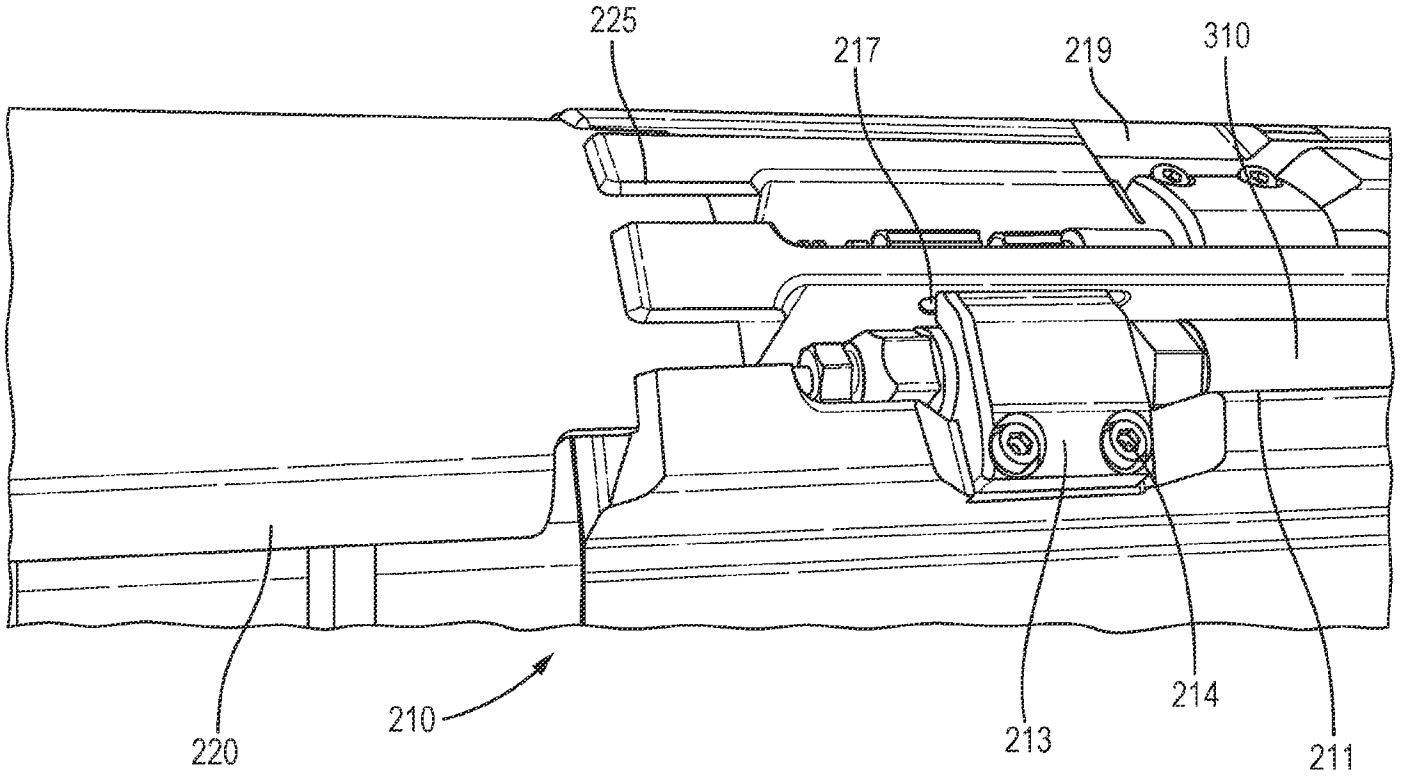
FIG. 6 shows a close-up view of the first protective element.
Figure 7:
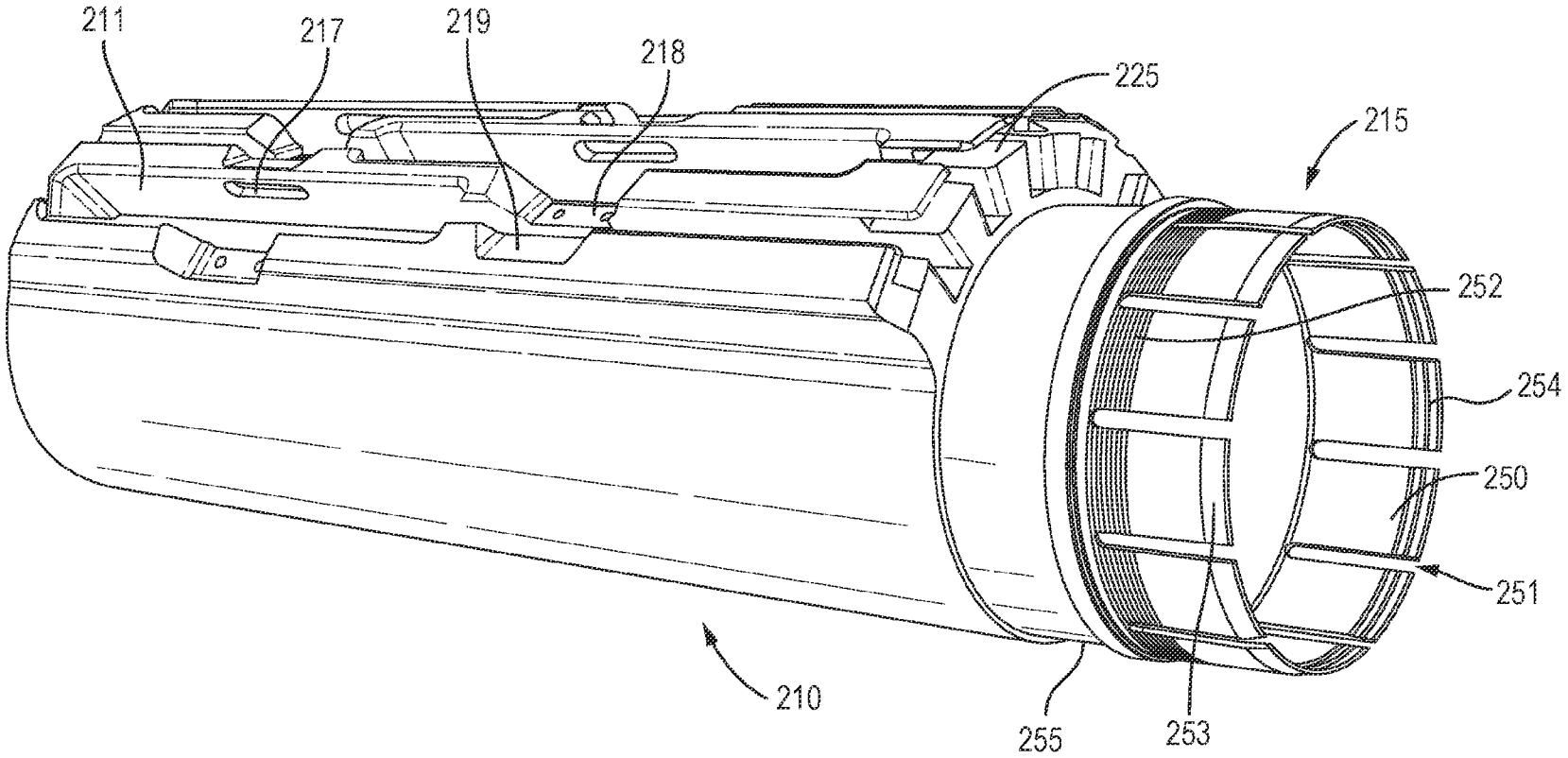
FIG. 7 shows a perspective view of the first protective element without control lines.
Figure 8:
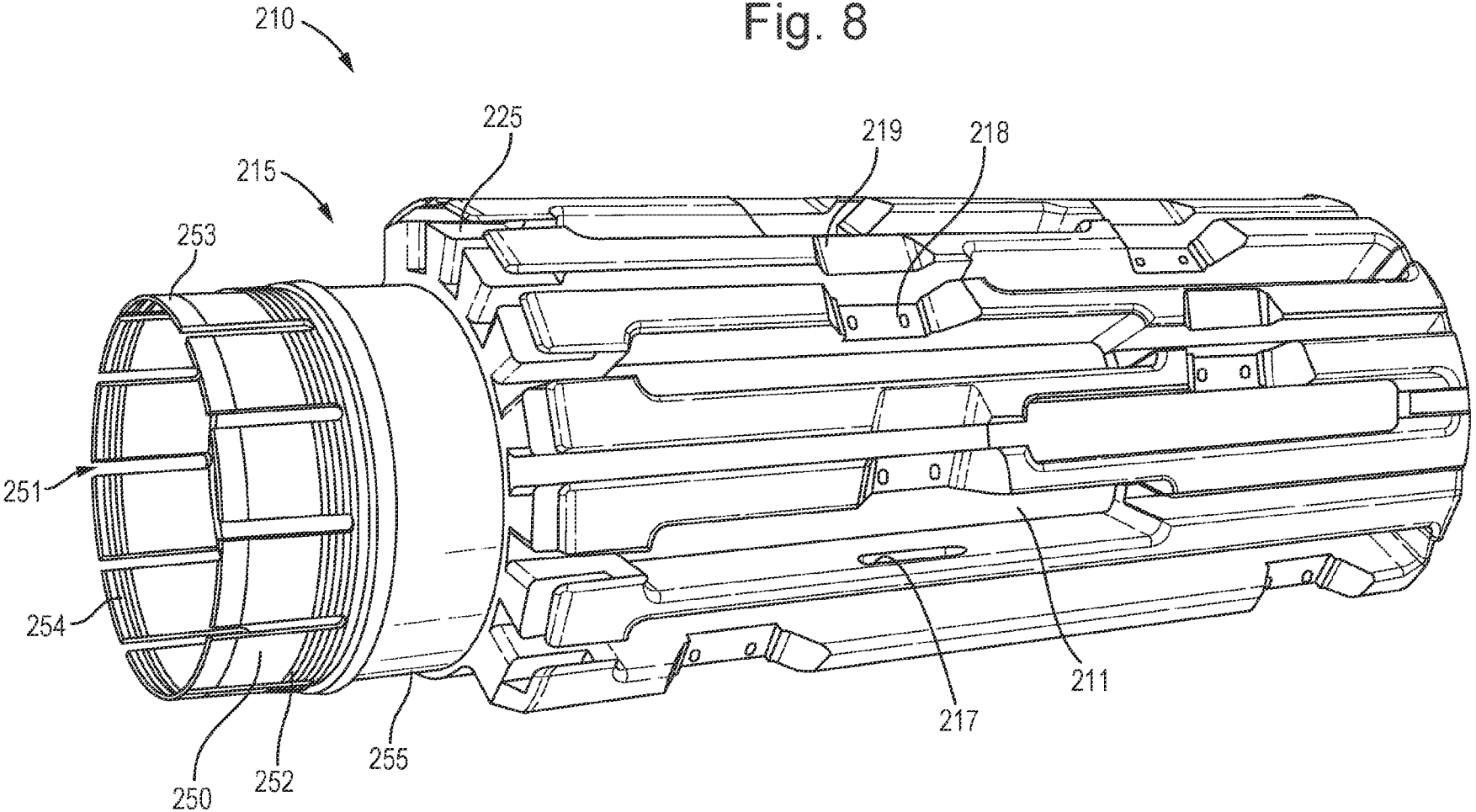
FIG. 8 shows an alterative perspective view of the first protective element without control lines.
Figure 9:
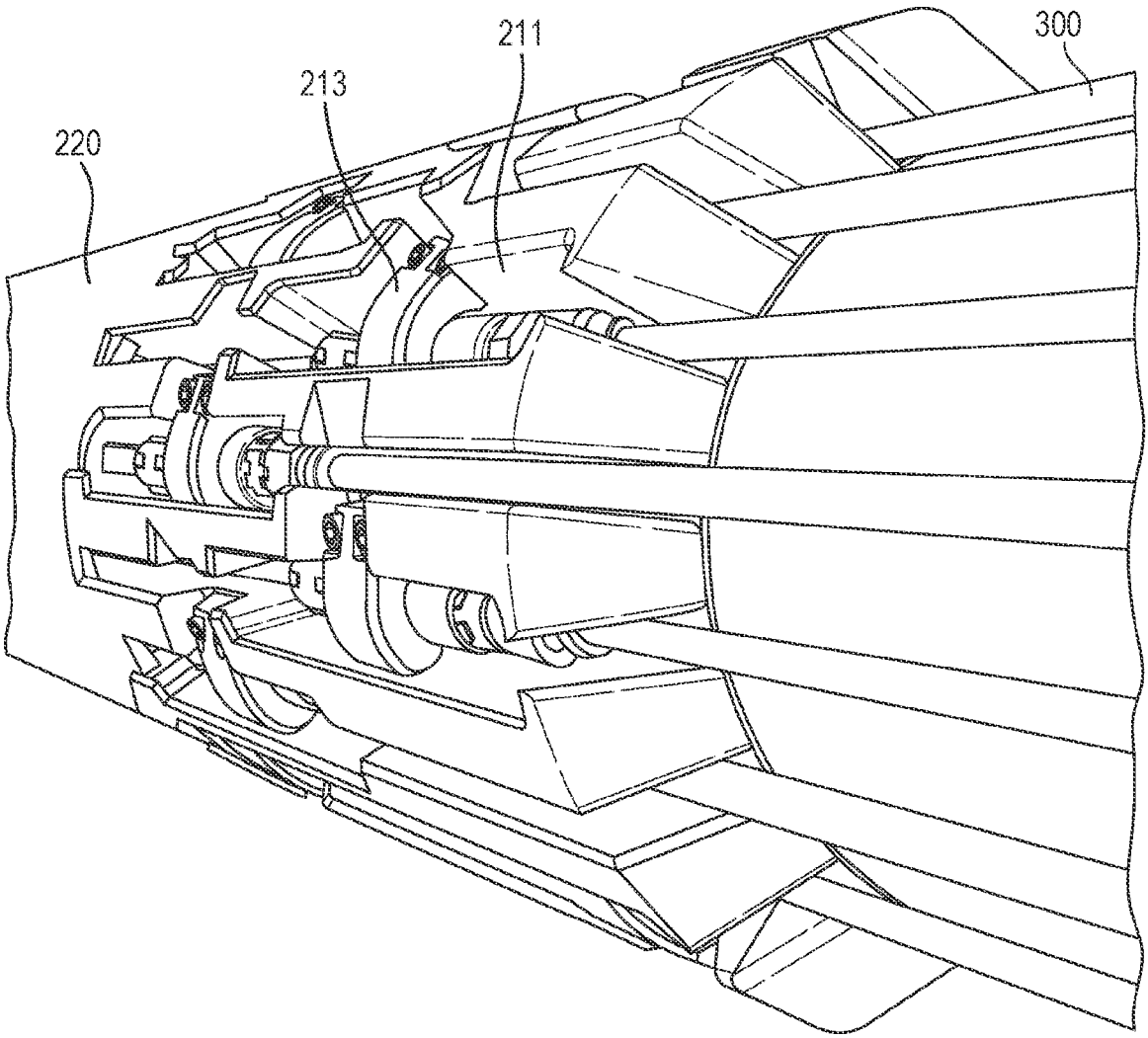
FIG. 9 shows a close-up perspective view of the first protective element.
Figure 10:
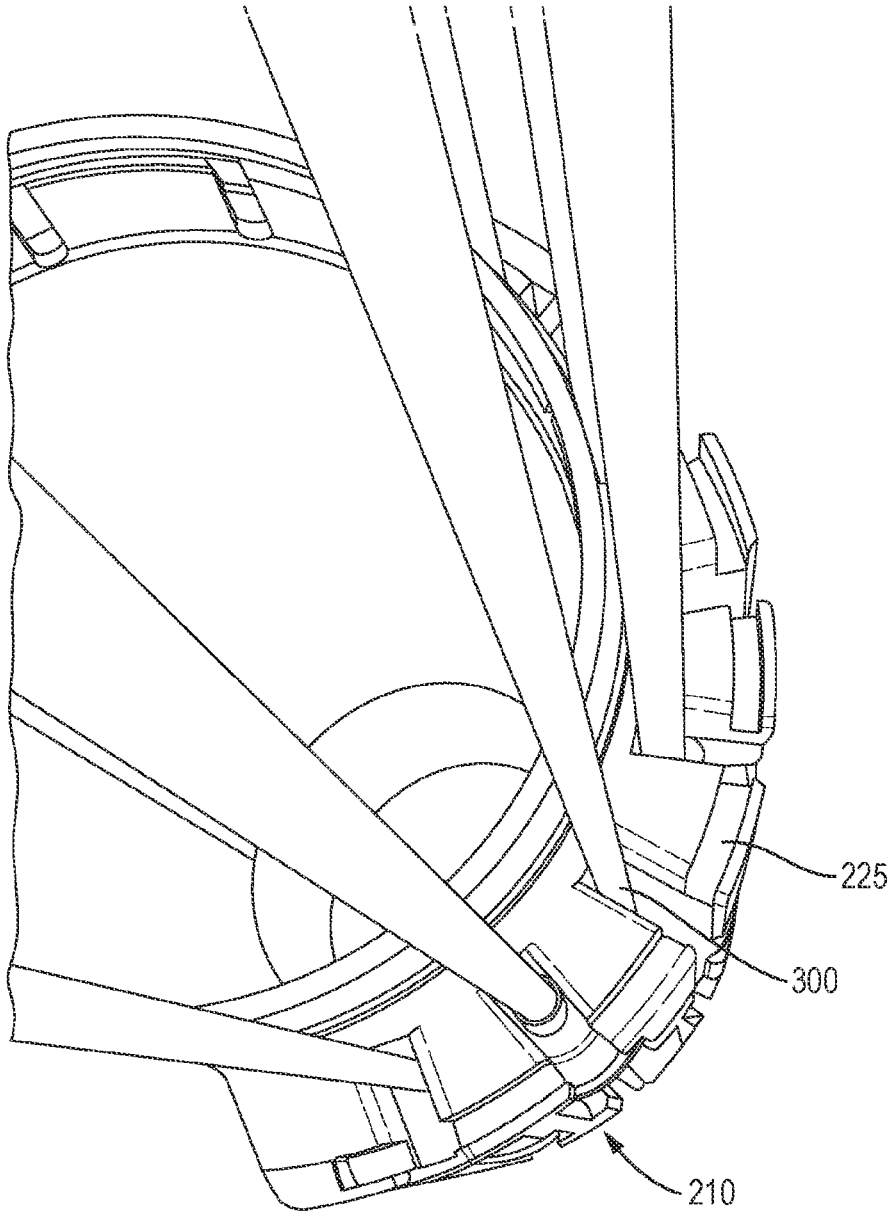
FIG. 10 shows an alternative close-up perspective view of the first protective element.
Figure 16:
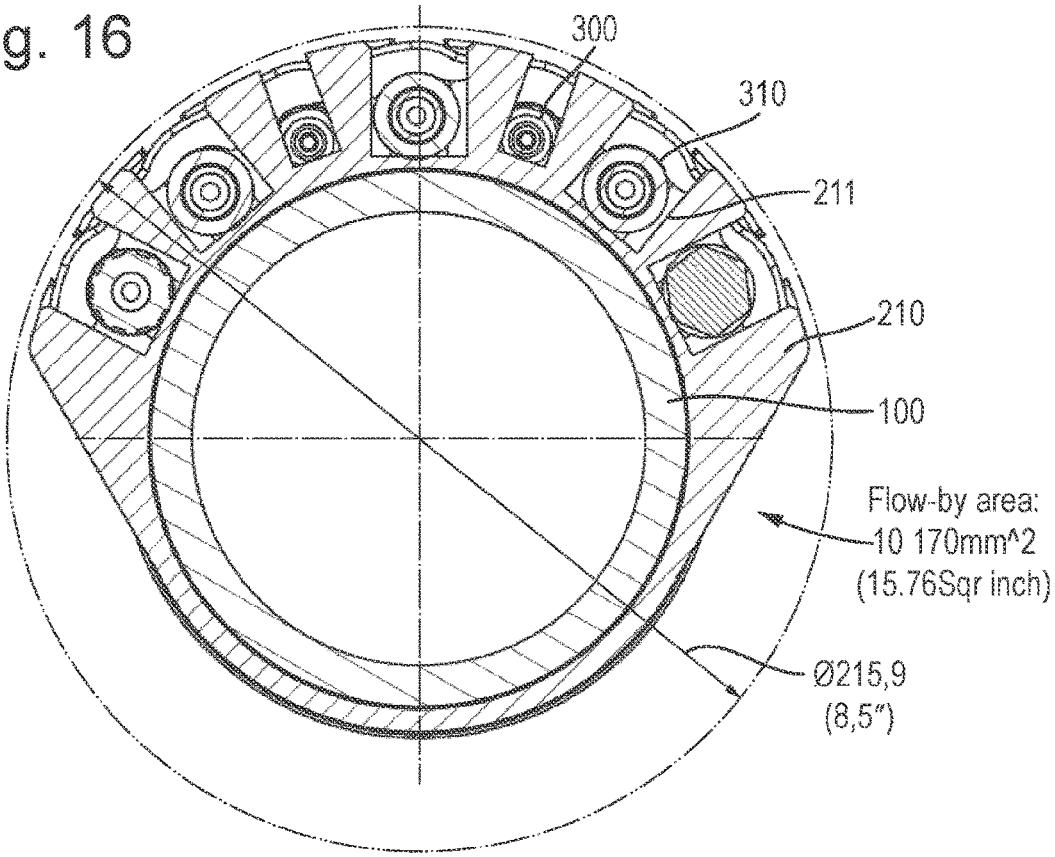
FIG. 16 is a technical drawing of the first protective element.

The first protective element 210 is shown in FIGS. 3 and 4 with the shield 220 removed, and alternative views of the first protective element 210 with the shield 220 attached are shown in FIGS. 5 and 6. FIGS. 7 and 8 show additional views of the first protective element 210 without the control lines 300. FIG. 16 shows a cross sectional technical drawing of the first protective element 210.

The first protective element 210 is illustrated abutting a box connection 110 (a wider female section at the end of a tubing for receiving a narrower male section of tubing), with the first protective element 210 flush against the box connection 110. It will be understood that the box connection 110 does not form a part of the control line connector 200 and that the control line connector can be installed independently of the box connection 110 (i.e. it does not need to be installed abutting a box connection or similar device).

The first protective element 210 is formed as a tubular body with an attachment mechanism at one end, and comprises several open channels 211, best illustrated in FIGS. 7 and 8.

The open channels 211 receive the control lines 300 and control line connectors 310, which are retained within the channels 211 by removable covers 213. Although not visible in the drawings, the surfaces of the channels 211 and the covers 213 ideally have a high coefficient of friction in order to grip the connectors 310 more effectively and mitigate the risk of the cables 300 or connectors 310 slipping. For example, the surfaces of the channels 211 that contact the control lines 300 and control line connectors 320 may be rough or textured, along with the radially inward facing surfaces of the covers 213.

Although the illustrated channels are open, alternative configurations are envisaged in part or all of the channel may be closed.

As described in more detail below, the control line connector 200 is installed by attaching it to a tubing, positioning the control lines 300 and control line connectors 320 in the channels 211, securing the covers 213 and shield 220 to the protective elements 210 and 230, and lowering the tubing into the wellbore.

As can be seen most clearly in FIG. 4, each connector 310 is retained by either one or two covers 213, with longer connectors 310 being retained by a two covers 213 positioned towards opposing ends of the connector 310, and shorter connectors 310 being retained by a single cover 213 positioned approximately at the middle of the connector 310. The number of covers 213 can be varied as necessary to ensure sufficient retention of the connectors 310, and embodiments are envisaged in which more than two covers are used to retain control line connectors.

Each channel 211 comprises narrow sections at opposing ends of a wider section. The narrow sections of the channel receive lengths of the actual control line 300, and the wider sections receive the control line connectors 310. The length of each wider section corresponds to the length of the control line connector 310 positioned in the channel 211. In this way, axial movement of the connector 310 relative to the protective element 210 is limited as the connector 310 is too wide to pass into the narrow region of each channel 211 and instead abuts against the protective element 210 during relative axial movement of the protective element 210 and connector 310.

Adjacent wider sections of the channel 211, and therefore the positions of corresponding adjacent connectors 310, are offset in the illustrated embodiment. This preferred arrangement is space efficient and allows additional room for the installation of the covers 213, but alternative configurations are envisaged where the wider sections of the channel 211 are not offset from one another.

The exact specifications of the channel will depend on the specifications of the control lines and control line connectors, which may vary depending upon the manufacturer and purpose of the control line. The wider portion of each channel may be wider and/or deeper than the narrower portion as needed depending upon the size of the control line connector being received in the channel.

As best seen in FIG. 6, the illustrated covers 213 of the first protective element 210 are formed of a single piece of material and have a curved profile, with the inner and outer surfaces both being curved. The curvature of the inner surface of the covers 213 ideally matches the curvature of the control line connectors 310 in order to maximise the contact area between the connectors 310 and the covers 213 and increase the gripping force that holds the control line connectors 310 in position within the channels 211.

The illustrated covers 213 are secured by bolts 214 inserted along one edge of the cover 213. The edge of each cover 213 opposing the bolts 214, which will be referred to as the leading edge, is inserted into an opening 217 in the first protective element 210, as most clearly visible in FIG. 7. Each cover 213 is installed by sliding the leading edge of the cover 213 into the opening 217 until the bolt holes on the cover 213 and first protective element 210 align. The bolts 214 are then inserted and tightened.

To assist in installing the covers 213, the first protective element 210 features recessed regions 218, visible in FIGS. 7 and 8, to receive each cover 213, and notched regions 219 that provide room to slide each cover 213 in to and out of the openings 217.

Although the illustrated covers 213 are secured by bolts, the covers could alternatively be secured by other means, such as using slots or retaining clips. Although the covers 213 could be permanently welded, it is preferable that they are removable in order to allow for easier servicing or replacement of control lines.

The illustrated first protective element 210 is tapered such that it narrows at one end. This tapering reduces the strain on the control lines 300 if they come in to contact with the first protective element 210, and also assists in inserting the control line protector 200 into a wellbore.

The first protective element 210 is attached to the tubing using an attachment mechanism at the end of the protective element 210 opposite the tapered end. The attachment mechanism is most clearly visible in FIGS. 4, 7, 8 and 13A-C and is comprised of two parts; namely a female sleeve 240 and a male attachment portion 215 formed as an integral internal collar with several gripping arms 250 extending from a tubular portion. The attachment mechanism mounts the protective element 210 to the outer surface of the tubing 100.

To fix or mount the protective element 210 to the tubing 100, the plurality of male gripping arms 250 are arranged to deflect or bend radially inward.

The male gripping arms 250 may also be referred to as fingers, deformable members or other interchangeable terminology to describe a plurality of elements which extend from a base toward a tip and bend inwardly to grip the pipe, the elements being separated by slots extending from the tip to the base. Gripping arms 250 of the attachment portion 215 interface with the female part of the attachment mechanism, that is, the sleeve 240. The gripping arms 250 are created by providing a plurality of equal length, linear and axially aligned slots 251 from the proximal end of the male part. A gripping arm 250 is formed between any two adjacent slots 251. Each of the gripping arms 250 extends axially away from a body of the first protective element 210.

When mounting the protective element 210 to the tubing 100, the male gripping arms 250 are bent radially inwards by the resilient female sleeve 240 which surrounds the attachment portion 215 when the two are press fit tighter. In this way, the male gripping arms 250 provide an inward force against the tubing 100 to fix the protective element 210 to the tubing 100.

Figure 13A:
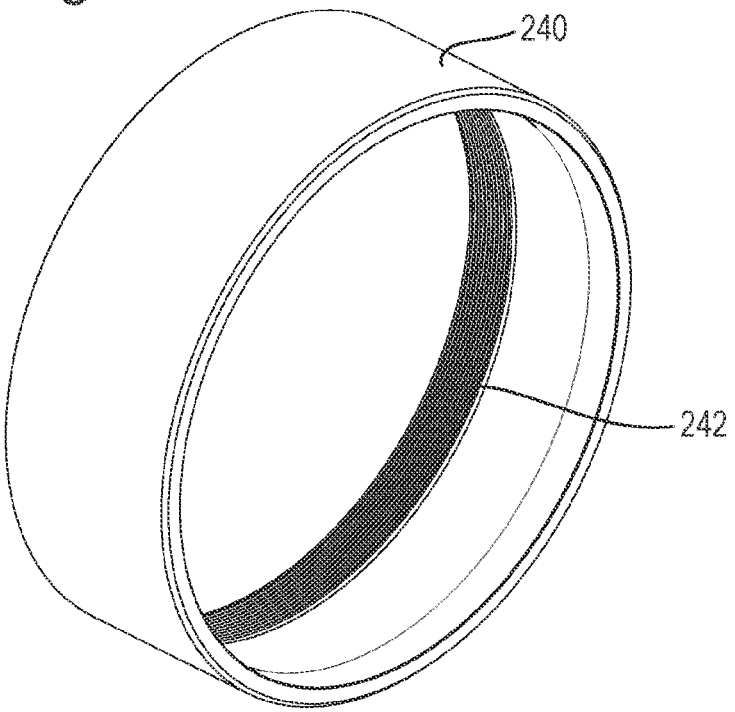
FIGS. 13A-C show a sleeve of the first and second protective elements.
Figure 13B:
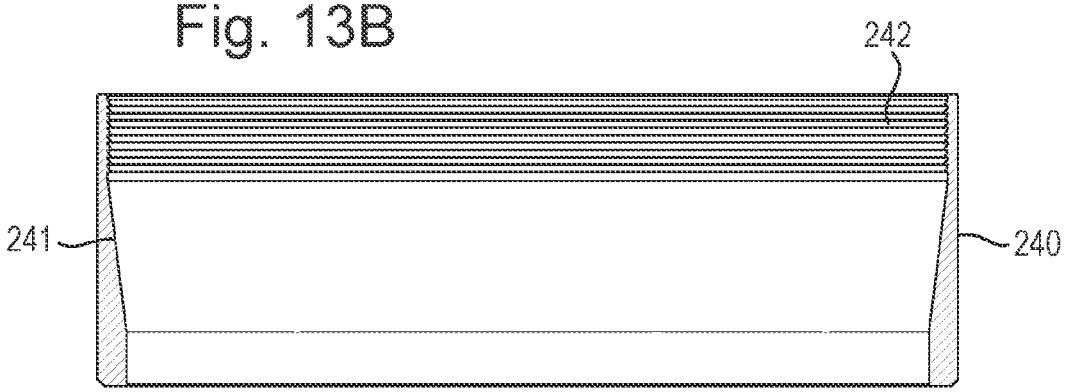
Figure 13C:
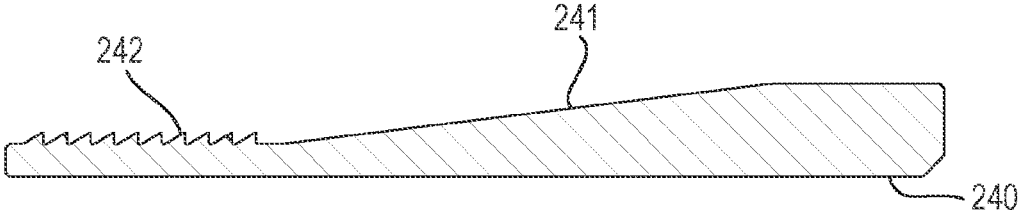

An example sleeve 240 is shown in FIGS. 13A-C. In use, at least a part of the attachment portion 215 is encircled by the sleeve 240, and the sleeve and attachment portion 215 are together a male-female connection with the sleeve 240 being a female part and the attachment portion 215 being the male part.

The sleeve 240 is substantially tubular. A section 241 of the wall of the sleeve 240 is tapered along the longitudinal axis of the sleeve 240 and is therefore shaped like part of the surface of the cone. The tapering is shown in FIGS. 13B and 13C, where the tapered sleeve causes one end of the sleeve wall to be thicker than the other.

Figure 14:
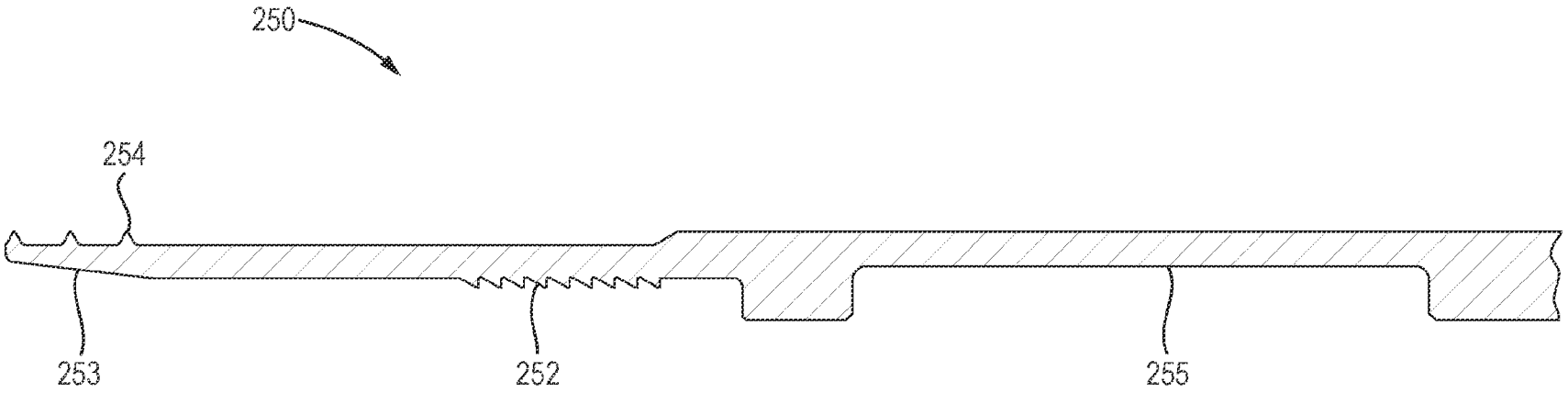
FIG. 14 shows a gripping arm of the first and second protective elements.

As shown in FIG. 14, the male gripping arms 250 of the protective element 210 may themselves have a tapered portion 253 with a narrower outer diameter at the tip of the arm 250, that is, at the distal end of the arm. In this way, the tapered arm 250 may more effectively abut the tapered sleeve 240.

To attach the protective element 210 to a tubing 100, the protective element 210 and the sleeve 240 are positioned axially on the tubing 100 and the attachment portion 215 is press fitted into the sleeve 240. The attachment portion 215 and the sleeve 240 are positioned on or around the tubing such that the end of the sleeve 240 with the lager inner diameter is forced over the end of the attachment portion 140 with the narrower outer diameter. As the sleeve 240 is pressed over the attachment portion 215, the conical inner portion of the sleeve 240 causes the male gripping arms 250 to deflect radially inwards to grip the tubing. The magnitude of deflection increases as the sleeve 240 is pressed further over the attachment portion, which reduces the inner circumference defined by the gripping arms 250. This allows for attachment to a relatively wide range of pipe sizes, as the sleeve 240 can be pressed on as far as needed to cause the appropriate gripping arm deflection for the radius of a given tubing.

Referring to FIG. 7, one or more ridged grooves/raised ridges/pawls 252 may be provided on the outer surface of the attachment portion 215, such as on each gripping arm 250. A plurality of ridged grooves/raised ridges/pawls 242 may also be provided on an inner surface of the sleeve 240. The ridges 252 on the attachment portion 215 and the ridges 242 on the sleeve 240 together form a ratchet so that after the sleeve has been pressed onto a position where the protective element 210 is sufficiently gripped to a pipe, the ratchet holds the attachment portion 215 in position.

The ridges 242 and 252 are each provided with a conical first face, for example with a pitch in the range of 20-35°, and an opposite second face that forms an abutment surface perpendicular to a central axis of the sleeve 240 or attachment portion 215. The ridges 242 and 252 are complementary to each other such that as the sleeve 240 is pressed axially onto the attachment portion 215, each ridge 242 on the sleeve 240 slides with a conical inward face against the conical outward faces of the circumferential ridges 252 of the attachment portion 215. The gripping arms 250 are displaced radially inwards until the ridges 242 of the sleeve 240 engage behind the ridges 252 of the attachment portion 215. Once engaged, abutment between the respective perpendicular second faces of the ridges 242 and 252 resists the sleeve 240 and attachment portion 215 being separated by an axial force, effectively locking the gripping arms 250, and therefore the attachment portion 215, within the sleeve 240. The ridges 242 and 252 are typically similarly shaped and arranged with regular axial spacing and corresponding pitch angles. A similar attachment mechanism is disclosed in WO 2014/011056 A1, which is hereby incorporated by reference.

As seen in FIG. 14, the inner surface of the male gripping arms 250 may comprise a plurality of teeth 254 which grip the pipe when the male gripping arms 250 are deflected radially inwards as the male and female parts are pressed together.

The illustrated teeth 254 are formed of a plurality of circumferential protrusions on the inner part of the male gripping arms 250 at the proximal end or tip of the arms. Circumferential teeth arranged in this way may prevent axial movement of the first protective element 210 relative to the tubing 100 by creating an edge which transmits force to the tubing.

The circumferential teeth 254 may further comprise a series of longitudinal slits (not shown) in the circumferential teeth of each male gripping arm 250. Such longitudinal slits help to prevent radial movement of the first protective element 210 by creating additional edges that can exert a radial force on the tubing 100.

Advantageously, attachment in this way means the control line protector 200 can be attached to a pipe by only pressing the male gripping arms 250 into the sleeve 240. No pins, screws or welding are required to attach the control line protector 200 to the tubing 100. In addition, the pipe diameter that the control line protector 200 can be attached to can be within a relatively wide tolerance range as the variable inner circumference of the control line protector 200 allows the protector 200 to be easily attached to pipes with different outer diameters. In addition, the attachment of the male gripping arms 250 to the tubing 100 due to the bending of the arms 250 allows a very strong gripping force to be applied to the pipe. Further advantages include the simple and low cost of construction.

When compared to conventionally mounted control line protectors, the control line protector of the present invention can be mounted to different tubings, which reduces the need for multiple size options and significantly reduces the cost of equipment manufacture and inventory overheads. The two piece attachment design is press-fit together to secure the equipment to the tubing off-line. The attachment mechanism delivers extremely high holding forces under all operating conditions.

Additionally, conventional control line protectors take a long time to install as the protectors are often screwed or welded onto the tubing. The press-fit connection of the present invention is quick and easy and dramatically increases the speed of installation and reduces the overall installation time. The control line protector can also be installed using a hand-held tool, which further reduces the installation overheads.

Referring back to FIGS. 7 and 8, to facilitate the press fit of the sleeve 250 and attachment portion 215, a setting tool groove 255 may be provided in an outer wall of the tubular body of the control line protector 200. The groove 255 is arranged to receive a first part of the setting tool, and the second part of the second tool is arranged at an opposite side of the sleeve 240 such that when the two parts of the setting tool are forced together, the sleeve 240 and the attachment portion 215 are press-fit together.

Although the illustrated attachment mechanism is comprised as part of the tubular body of first protective element 210, alternative embodiments are envisaged in which a separate tubular attachment mechanism is used, with the gripping arms 250 forming part of a standalone male collar that inserts into the female sleeve 240 to grip the tubing 100. Such a separate attachment mechanism could abut against the first protective element 210, possibly with one attachment mechanism at each end of the protective element 210, which would allow for rotation movement of the first protective element 210 about the tubing 100.

Alternatively, a single separate attachment assembly 215 could be coupled to the first protective element 210 by means of one or more latching elements that attach to first protective element 210 in a way that prevents relative axial movement of the attachment mechanism and the first protective element 210. In this case, the attachment assembly 215 could be formed as a separate inner collar with the gripping arms 250 on one side of the collar, and a plurality of latching arms (not shown) extending in an axial direction on an opposing side of the collar. Such latching arms could latch into a circumferential recess, slot or groove on the inner or outer surface of the first protective element 210, thereby preventing axial movement but allowing rotational movement. The latching arms may alternatively be referred to as fingers, and may be any element that functions to interface with the first protective element 210. For example the latching elements may deflect radially outward when they are pressed into a female part of the first protective element 210, and they may have one or more recesses that interface with the first protective element 210.

Example latching elements or fingers are disclosed in GB 2561866 A, which is hereby incorporated by reference.

Such a coupling could potentially also restrict relative rotational movement of the attachment mechanism and the first protective element 210 by using separate recesses or grooves on the first protective element 210 to receive each latching arm, wherein the size of each recess corresponds to the size of each latching arm. Alternative embodiments are also envisaged in which a degree of rotational freedom is allowed over a predetermined range of rotation angles, for example by using separate recesses that are slightly wider than the width of the latching arms. This would provide some rotational tolerance to reduce strain on the control lines, while still limiting rotation in order to prevent the cables becoming tangled. The magnitude of allowable rotation would depend on the relative widths of the recesses and the latching arms, with wider recesses affording greater rotational freedom.

Alternative embodiments are also envisaged in which the female sleeve 240 is formed as an integral component of the protective element 210, and the attachment portion 215 is a separate collar, i.e. the attachment portion 215 and the sleeve 240 are effectively swapped. In this case, the end of the first protective element 210 would be formed as an outer sleeve that is pressed over a separate inner collar having a plurality of gripping arms. Similarly, in embodiments with latching arms, the latching arms may be arranged at one end of the first protective element 210 and configured to interface with one or more recesses on a separate attachment assembly 215.

Figure 17:
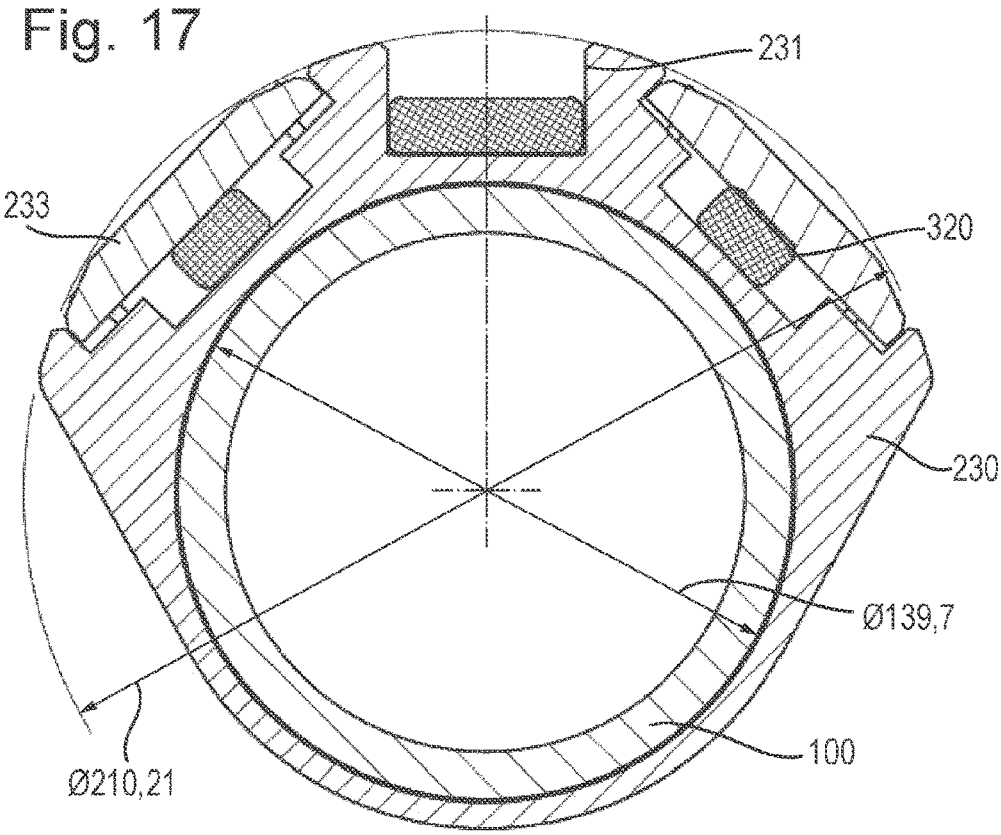
FIG. 17 is a technical drawing of the second protective element.

The second protective element 230, visible in FIGS. 1 and 2, is largely similar to the first protective element 210 in that it has a substantially tubular body with several channels and an attachment portion and shares additional features such as a tapered end. FIG. 17 shows a cross sectional technical drawing of the second protective element 230.

In the illustrated embodiment, rather than the channels receiving bare control lines, the second protective element 230, the channels 231 of the second protective element 230 receive the housings 320 in which multiple control lines are spliced together. The width of the channel 231 varies depending on the size of the housings 320. Alternatively, the second protective element 230 could receive individual control lines and/or control line protectors without housings, as with the first protective element 210.

As with the first protective element 210, covers 233 retain the housings 320 within the channels 231 of the second protective element 230. The surfaces of the channels 231 and the covers 233 ideally have a high coefficient of friction in order to grip the housings 320 more effectively and mitigate the risk of the housings 320 slipping. For example, the surfaces of the channels 231 and the covers 233 may be rough or textured.

Unlike the covers 213 on the first protective element 210, the illustrated covers 233 on the second protective element 230 are secured by bolts on two opposing sides. In this case, the covers 233 are installed by positioning them in recessed regions 238 with the bolt holes of each cover 233 aligned with bolt holes on the body of the second protective element 230. Bolts 234 are then inserted and tightened. As with the covers 213 on the first protective element 210, alternative securing means are envisaged, such as using slots or retaining clips.

As with the first protective element 210, the second protective element 230 comprises an attachment mechanism at one end. The configuration and function of the attachment mechanism is the same as that of the attachment mechanism described in relation to the first protective element 210, comprising a male attachment portion 235 with several gripping arms and a female sleeve 240, so these details will not be repeated.

Similar to the attachment mechanism of the first protective element 210, the attachment mechanism of the second protective element 230 may potentially be formed as a separate attachment mechanism that either abuts or couples to the second protective element 230, and the roles of the sleeve 240 and the attachment portion 235 could be reversed.

Figure 11:
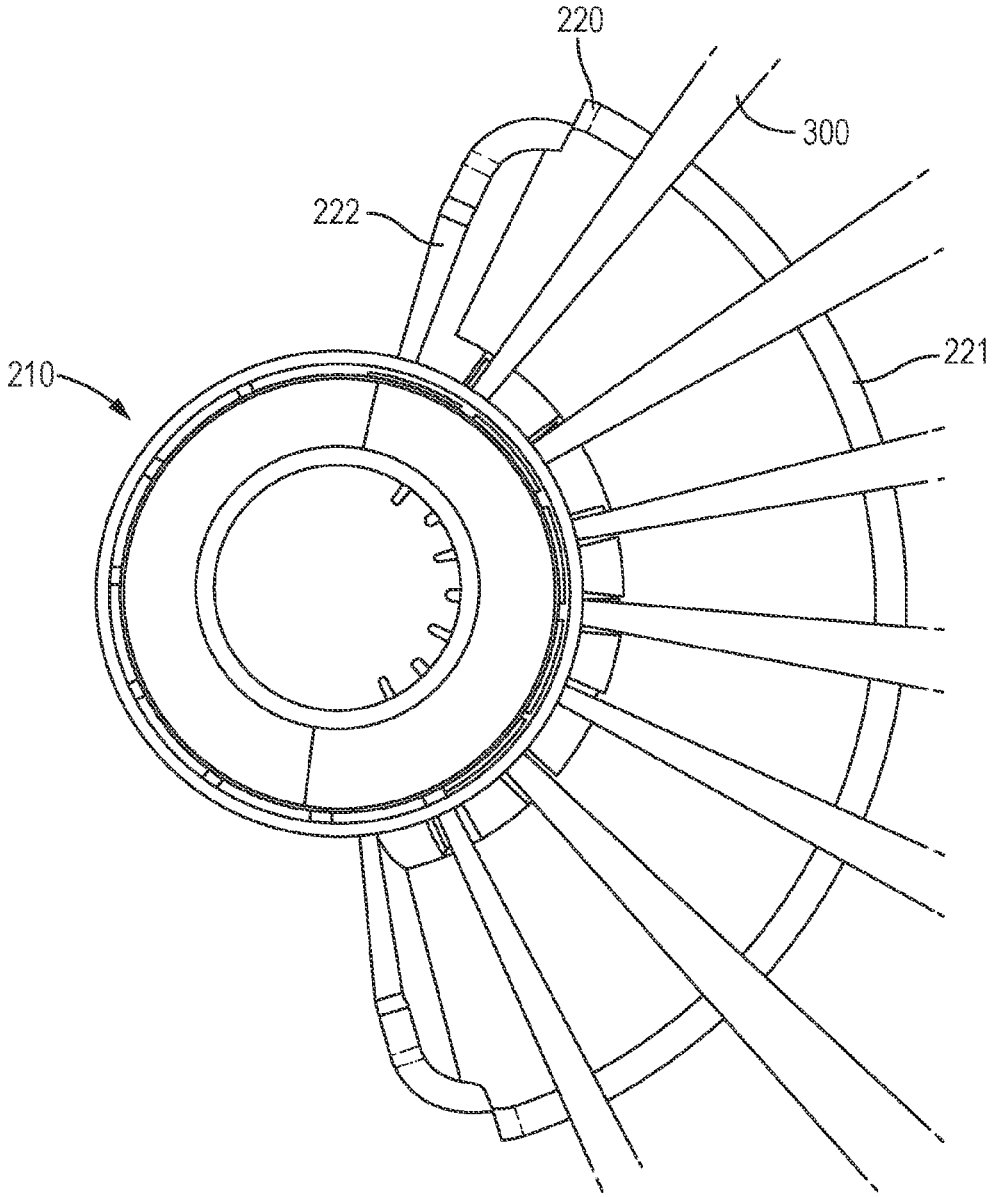
FIG. 11 shows another alterative close-up perspective view of the first protective element.
Figure 12:
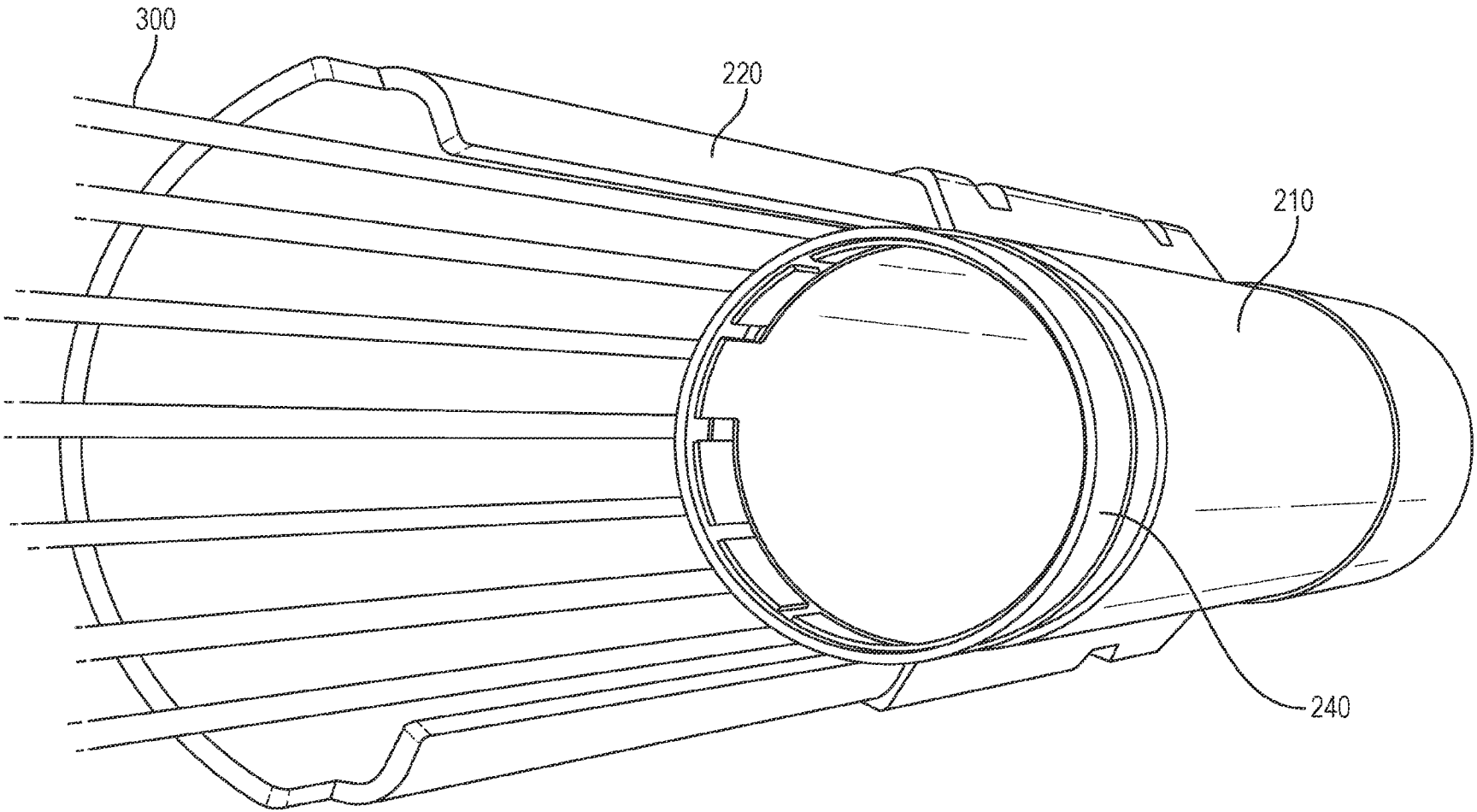
FIG. 12 shows an alternative perspective view of the first protective element.

As mentioned above, the shield 220 protects the control lines 300 in a region between the first and second protective elements 210 and 230. As most clearly visible in FIG. 11, the shield 220 has a main body section 221 with a cross section similar to the arc of a circle, and a lip 222 on either side, thereby forming a substantially enclosed region around the control lines 300 between the shield 220 and the tubing 100. The illustrated shield covers approximately half of the circumference of the tubing, although alternative configurations are envisaged in which the shield is larger or smaller to cover a greater or lesser proportion of the tubular's circumference, for example to protect more or fewer control lines respectively.

The shield 220 couples to the first protective element 210 by sliding it into the grooves 225 of the first protective element 210. The opposite end of the shield 220 abuts against a ledge section 236 of the second protective element 230 during installation and use, and is held in place by retaining elements 237 of the second preventive element 230, which are slidable between disengaged and engaged positions. Alternative configurations are envisaged for connecting the shield to the protective elements, for example by using bolts or screws to secure the shield to one or both protective elements.

When forcing the male and female parts of the attachment mechanism together, any number of known tools for press fitting tubular parts that are arranged around the pipe may be used. For example, the tool as shown in FIGS. 2 and 3 of U.S. Pat. No. 3,040,405, which is hereby incorporated by reference, may be used.

To install the control line protector 200, the first and second protective elements 210 and 230 and corresponding sleeves 240 are positioned axially on the tubing 100. The protective elements 210 and 230 are arranged with the appropriate separation required by the shield 220. The correct separation can be ensured by carefully measuring the distance between the protective elements, or could alternatively be achieved by installing the protective elements with the sleeve in position, i.e. already coupled to the protective elements.

Once both protective elements are in position, the installation tool is used to press-fit the sleeves 240 over the attachment portion of each protective element. As described above, this causes the gripping arms 250 to deflect radially inwards to grip the tubing 100.

With the covers 213 and 233 and shield 220 removed, the control lines 300 and housings 320 are then positioned within the channels 211 and 231 respectively with the control line connectors 310 in the wider sections of channels 211, as described above.

The covers 213 and 233 are then bolted in position to retain the control line connectors 310 and housings 320, and the shield is installed by positioning one end of the shield in groove 225 and using retaining elements 237 to secure it in position.

The control line protector according to embodiments of the invention is suitable for industrial applications, in particular for use in the subsea oil and gas industry. The elements of the control line protector may be made of any material known for such applications, such as steel. The dimensions of the components described may be adapted as required to the pipes and other devices used in these industries.

The invention claimed is:

1. A control line protector system comprising:

a control line connector that joins sections of control lines together in a control line; and a control line protector for protecting one or more downhole control lines running alongside a pipe, comprising:

a body with one or more channels, wherein a channel of the one or more channels receives the control line, and wherein the body surrounds the pipe along an entire length of the body;

wherein the channel comprises a wider portion that receives the control line connector and a narrower portion that receives the control line; and an attachment assembly coupled to the body for attachment to an outer surface of the pipe, wherein the attachment assembly comprises:

an inner collar comprising a tubular portion and a plurality of gripping arms extending axially away from the tubular portion and arranged to deflect radially inwards; and an outer sleeve adapted to slide at least partially over the inner collar;

wherein when the inner collar and the outer sleeve are arranged axially around the pipe and pressed together each of the plurality of gripping arms is deflected radially inwards by the outer sleeve to grip the pipe and thereby secure the body to the outer surface of the pipe.

2. The control line protector of claim 1, wherein the body comprises part of the attachment assembly.

3. The control line protector of claim 2, wherein the body comprises the inner collar or the outer sleeve.

4. The control line protector of claim 1, wherein the attachment assembly is separate from the body.

5. The control line protector of claim 4, wherein the attachment assembly is coupled to the body such that the body can move rotationally relative to the pipe and the attachment assembly.

6. The control line protector of claim 5, wherein the relative rotational movement is limited to a predetermined range of rotational angles about the axis of the pipe that is less than a complete rotation.

7. The control line protector of claim 1, further comprising a second attachment assembly coupled to the body.

8. The control line protector of claim 7, wherein the attachment assembly is arranged at one end of the body and the second attachment assembly is arranged at an opposite end of the body.

9. The control line protector of claim 1, further comprising a shielding element configured to be coupled to the body such that, in use, the shielding element protects sections of the downhole control lines in a region adjacent to the body.

10. The control line protector of claim 9, further comprising an additional body configured to be coupled to the shielding element, and wherein the additional body comprises one or more further attachment assemblies.

11. The control line protector of claim 10, wherein the additional body comprises two further attachment assemblies, wherein the two further attachment assemblies are arranged at opposing ends of the additional body.

12. The control line protector of claim 9, wherein the body comprises a shield groove for receiving an end of the shielding element.

13. The control line protector of claim 9, wherein an axial edge of the shielding element comprises a lip which, in use, is arranged to substantially enclose sections of the control lines in a region between the shielding element and the pipe.

14. The control line protector of claim 1, wherein each of the one or more channels comprises one or more covers for retaining the control line or control line connector in the respective channel.

15. The control line protector of claim 14, wherein the body comprises one or more cover openings for receiving at least part of the one or more covers, and wherein the body further comprises one or more cover grooves that allow the one or more covers to be slideably positioned in the one or more cover openings.

16. The control line protector of claim 14, wherein the body further comprises one or more recesses for receiving the one or more covers, wherein in use, each of the one or more covers is positioned in a corresponding recess such that at least a part of each cover is positioned below an outer surface of the body.

17. A method of securing the control line protector of claim 1 to a pipe, the method comprising positioning the outer sleeve and the inner collar around the pipe and press-fitting the second attachment element into the first attachment element such that abutment between the outer sleeve and inner collar causes each of the plurality of gripping arms of the inner collar to deflect radially inwards thereby to grip an outer surface of the pipe.

18. The method of claim 17, further comprising:

positioning control line connectors and/or control lines in the channels;

fixing one or more removable covers to the control line protector;

fixing a shield to the control line protector; and positioning one or more additional outer sleeves and one or more additional inner collars around the pipe and press-fitting each of the one or more additional inner collars into a respective additional outer sleeve.

19. A control line protector system comprising:

a control line connector that joins sections of control lines together in a control line; and a control line protector for protecting one or more downhole control lines running alongside a pipe, comprising:

at least one body with one or more channels, wherein a channel of the one or more channels receives a control line, and wherein the at least one body surrounds the pipe along an entire length of the body;

wherein the channel comprises a wider portion that receives the control line connector and a narrower portion that receives the control line;

at least one shielding element configured to be coupled to the body such that, in use, the shielding element protects sections of the downhole control lines in a region adjacent to the body; and at least one attachment assembly coupled to the at least one body for attachment to an outer surface of the pipe, wherein the attachment assembly comprises:

an inner collar comprising a tubular portion and a plurality of gripping arms extending axially away from the tubular portion and arranged to deflect radially inwards; and an outer sleeve adapted to slide at least partially over the inner collar;

wherein when the inner collar and the outer sleeve of each attachment assembly are arranged axially around the pipe and pressed together each of the plurality of gripping arms is deflected radially inwards by the outer sleeve to grip the pipe and thereby secure the one or more bodies to the outer surface of the pipe.

20. A control line protector for protecting one or more downhole control lines running alongside a pipe, comprising:

a body with one or more channels, wherein each of the one or more channels is adapted to receive a control line; and an attachment assembly separate from the body and coupled to the body for attachment to an outer surface of the pipe, wherein the body can move rotationally relative about the pipe relative to the attachment assembly, wherein the attachment assembly comprises:

an inner collar comprising a tubular portion and a plurality of gripping arms extending axially away from the tubular portion and arranged to deflect radially inwards; and, an outer sleeve adapted to slide at least partially over the inner collar, wherein when the inner collar and the outer sleeve are arranged axially around the pipe and pressed together each of the plurality of gripping arms is deflected radially inwards by the outer sleeve to grip the pipe and thereby secure the body to the outer surface of the pipe.

* * * * *